US005305530A

United States Patent [19]

Robertson, Jr. et al.

[11] Patent Number: 5,305,530

[45] Date of Patent: Apr. 26, 1994

[54] ARCHER'S BOW SIGHT

[76] Inventors: George B. Robertson, Jr., 346 Harmon Johnson Rd., Monroe, La. 71202; Eric J. Broadway, Rte. 3, Box 684, Rayville, La. 71269

[21] Appl. No.: 101,039

[22] Filed: Aug. 3, 1993

[51] Int. Cl.[5] ..... F41G 1/467

[52] U.S. Cl. ..... 33/265; 124/87

[58] Field of Search ..... 33/265, 260, 283; 124/87

[56] References Cited

U.S. PATENT DOCUMENTS

| | | | |
|---|---|---|---|
| 4,026,032 | 5/1977 | Smith | 33/265 |
| 4,120,096 | 10/1973 | Keller | 33/265 |
| 4,368,581 | 1/1983 | Tullo | 33/265 |
| 4,580,349 | 4/1986 | Webb | 33/265 |
| 4,711,036 | 12/1987 | Morris | 33/265 |
| 4,884,347 | 12/1989 | Larson | 33/265 |
| 4,894,921 | 1/1990 | Barlow | 33/265 |
| 4,974,328 | 12/1990 | Lowry | 33/265 |
| 5,048,193 | 9/1991 | Hacquet | 33/265 |
| 5,121,547 | 6/1992 | Littlejohn | 33/265 |

*Primary Examiner*—William A. Cuchlinski, Jr.

*Assistant Examiner*—G. Bradley Bennett

*Attorney, Agent, or Firm*—Richard C. Litman

[57] ABSTRACT

A bow sight for use in archery hunting provides for the automated compensation of target distance and elevation differential factors when bow hunting from a relatively elevated site, such as a tree stand. The sight is formed in a generally L shaped configuration, with a pivot at the juncture of the two legs. The forward leg includes a plurality of sight pin mounting points, into which a close distance sight pin and a far distance sight pin may be installed. The sight is mounted to a bow, and the pivot provides for the sight and pins to maintain a constant position relative to the horizontal. An adjustable balance weight is provided in the rear leg of the device for fine adjustment. As the bow is raised or lowered to adjust for different target distances, one of the two sight pins will always appear to be lower than the other, or in a singular situation will be aligned with one another. An archer may use the sight by aligning the lowest of the two pins (or the two pins together for a middle distance target) with the target, thus eliminating any confusion as to which of a plurality of pins to use.

15 Claims, 3 Drawing Sheets

ARCHER'S BOW SIGHT

FIELD OF THE INVENTION

The present invention relates generally to sights and aiming aids for manually actuated weapons, and more specifically to a pendulum type, gravity stabilized archer's bow sight adapted for use from an elevated site such as a tree stand and operable over variable shooting distances and compensating for any drop in the path of an arrow when fired.

BACKGROUND OF THE INVENTION

While archery may at first glance appear to be a somewhat anachronistic sport, its popularity has gained steadily. Much of the reason for this increasing popularity, particularly in hunting, is the far greater challenge involved in shooting game with a manually operated weapon (such as a long or compound bow) as compared to a rifle or other explosively powered weapon. In addition to the above consideration, most jurisdictions provide longer hunting seasons, higher limits, or other considerations to hunters using bows and/or other manually powered weapons.

One of the reasons behind the greater challenges and legal advantages noted above, is that such manually powered weapons as bows are inherently more difficult to aim accurately, particularly over relatively long distances. This is due not only to the lack of sighting means along the propulsive axis of the weapon, as in the case of firearms, but also due to the lesser forces provided to the projectile by manual operation and the consequently slower flight and greater drop in the path of the projectile. As a result, various devices have been developed to aid in the accurate aiming of bows and like manually powered weapons. However, for the most part these devices are excessively complex in order to attempt to achieve the desired accuracy, and consequently are at odds with the inherent simplicity of the sport of archery. This is particularly true in the case of sighting devices developed for use by archers from elevated stations, due not only to the drop of the arrow or projectile while in flight, but also due to the greater elevation of the site relative to the target.

The need arises for a sight for use in archery hunting which not only compensates for variation in range to the target, but also for the difference in elevation between a target and an archer shooting from an elevated site or platform, as in a tree stand. The sighting device or aid must be relatively simple in construction and in operation, yet provide accurate compensation for both range and elevation factors for the archer.

DESCRIPTION OF THE PRIOR ART

U.S. Pat. No. 4,026,032 issued to Jimmie T. Smith on May 31, 1977 discloses a Bow Sight Mechanism comprising several laterally disposed sight pins providing threadable adjustment for windage. The several pins are installed within a vertical slot and provide for several simultaneous range settings. However, each of the range pins must be preset and are incapable of any automatic adjustment for elevation, as in the case of the present invention. Moreover, the several pins are confusing to use, particularly in a rapidly changing situation where a shot must be made quickly.

U.S. Pat. No. 4,368,581 issued to Charles E. Tullos on Jan. 18, 1983 discloses a Bow Sight having only a single ring sight with a sight bead therein, but including numerous adjustments therefor. The sight may be adjusted vertically to compensate for range; adjusted horizontally to compensate for windage; and moreover, the sight ring itself may be adjusted in its holder. Even with all the above adjustments, no specific means is provided for mass adjustment of the pendulum itself for fine adjustment, as in the present invention. While the device may be locked for use in archery over distances of like elevation, the present invention may also be used in such an environment if so desired, with proper adjustment, and without the cumbersome multiple adjustments required for the single sight ring of Tullos.

U.S. Pat. No. 4,580,349 issued to Leamon G. Webb et al. on Apr. 8, 1986 discloses a Range Finder For A Bow having several adjustably located sight pins laterally installed through a generally vertical plate. In addition, a pendulum sight is provided, but no mass adjustment for the pendulum is provided. The device requires the adjustment and repositioning of the five sight pins to correspond with range markings, which process is relatively cumbersome and time consuming.

U.S. Pat. No. 4,711,036 issued to Eddy Morris on Dec. 8, 1987 discloses a Pendulum Operated Oscillating Bow Sight comprising an enclosed pendulum operating a plurality of lever arms and a sight slidably disposed in a slot. The entire apparatus is simplified by having only a single sight pin, but the increased friction of the multiple levers and elements result in the device being relatively inaccurate. Moreover, no mass adjustment means for the bob weight or pendulum is disclosed for fine adjustment. One embodiment of the apparatus includes even greater complexity, having a series of light emitting diodes to aid in sighting. The resulting complexity is well beyond the scope of the present invention.

U.S. Pat. No. 4,884,347 issued to Marlow W. Larson on Dec. 5, 1989 discloses a Bow Sight having numerous sight pins installed in a pendulum plate. The plate can be locked if desired for use on level ground, but the numerous sight pins and complex apparatus are beyond the scope of the present invention.

U.S. Pat. No. 4,894,921 issued to William J. Barlow on Jan. 23, 1990 discloses a Rangefinder Bow Sight including a series of LEDs providing annunciator means indicating proper bow positioning, somewhat in the manner of the Morris device discussed above. Again, several sight pins are provided, but as in the case of the Morris and Larson devices discussed above, no pendulum weight adjustment means is provided.

U.S. Pat. No. 4,974,328 issued to Abner P. Lowry on Dec. 4, 1990 discloses a Pendulum Bow Sight having two pivotal components adjustably secured to one another. The adjustment provides for range and height variation. In addition, a single sight pin must also be adjusted within a slot for maximum accuracy. Again, no adjustment of the pendulum balance weight is provided for fine tuning of the apparatus, as in the case of the present invention.

U.S. Pat. No. 5,048,193 issued to Rodney D. Hacquet on Sep. 17, 1991 discloses an Archery Bow Sight having a series of vertically adjustable front sight pins and a rear sight notch, the front sight pins and rear sight being installed at opposite ends of an elongate arm. The rear sight notch assembly is pivoted as a pendulum to the rear end of the arm, but the relatively short distance of the sight notch from the pivot point relative to the distance between front and rear sights, is not seen to provide a significant variation as the bow is tilted for elevational adjustment. Moreover, at least three sight pins are provided, one of which must be aligned with the rear sight notch, thus making the device relatively complex and cumbersome to use, notwithstanding the length of the entire sight arm arrangement.

Finally, U.S. Pat. No. 5,121,547 issued to Bert K. Littlejohn on Jun. 16, 1992 discloses a Pendulum Bow Sight With Telescopic Scope. The telescopic sight is pivotally mounted to a gear train, which gear train is actuated by the pendulum. The same problems arise with this apparatus as with the Morris apparatus discussed above, i.e., the mechanical friction of the numerous movably interrelated components appears likely to reduce accuracy, thus negating any advantage of greater aiming accuracy provided by a scope. While only one sight pin is provided, a series of cross hairs is provided within the scope. The archer must determine which cross hair to use, depending upon the desired range to the target.

None of the above noted patents, taken either singly or in combination, are seen to disclose the specific arrangement of concepts disclosed by the present invention.

SUMMARY OF THE INVENTION

By the present invention, an improved archery bow sight is disclosed.

Accordingly, one of the objects of the present invention is to provide an improved archery bow sight which provides improved accuracy for archers shooting from an elevated position, such as from a tree stand.

Another of the objects of the present invention is to provide an improved archery bow sight which is gravitationally stabilized by pendulum means to adjust automatically for variation in the angle of the projectile flight path relative to the horizontal.

Yet another of the objects of the present invention is to provide an improved archery bow sight which includes provision for sighting targets at relatively close, midrange, and far distances by means of the alignment of only two sight pins.

Still another of the objects of the present invention is to provide an improved archery bow sight which includes plural sight pin positioning means for large adjustments in arrow weight, elevation height, or other need for relatively large adjustment.

A further object of the present invention is to provide an improved archery bow sigh which includes means for relatively fine adjustment by means of a threadibly adjustable balance weight.

A final object of the present invention is to provide an improved archery bow sight for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
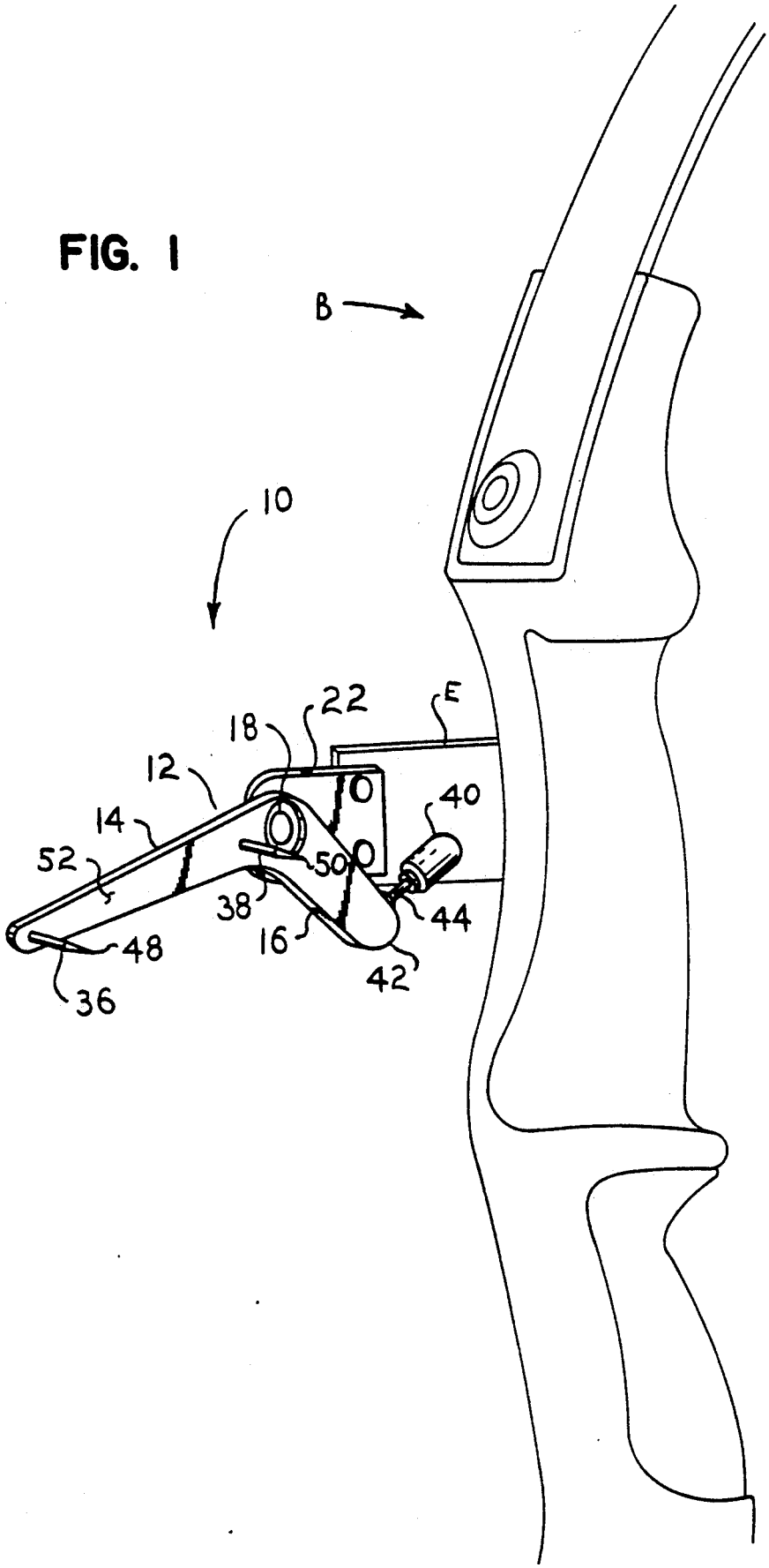
FIG. 1 is a front perspective view of the archery bow sight of the present invention as it would be installed upon an archery bow and showing its general configuration and features.

Referring now to the drawings, the present invention will be seen to relate to an archery bow sight 10 installable upon an archery bow B and providing compensation for differences in elevation between an archer and a target, as well as compensation for variable target distances. Bow sight 10 includes a pivotally mounted, generally L shaped sight arm 12 having a relatively longer forward sight extension 14 and a relatively shorter rearward balance extension 16. The sight arm 12 includes a bearing 18 at the juncture 19 of the forward and rear extensions 14 and 16, which bearing 18 is preferably a very low friction bearing (e.g., ball, roller, etc.) and is mounted upon a generally horizontal axle 20 and transverse to the line of flight of an arrow or other projectile shot from bow B. Axle 20 is in turn secured to a mounting bracket 22, which bracket 22 provides adjustable attachment to the bow B or to an extension E thereon by means of slotted attachment means and/or vertical channels providing for slidable mounting, etc.

Figure 2:
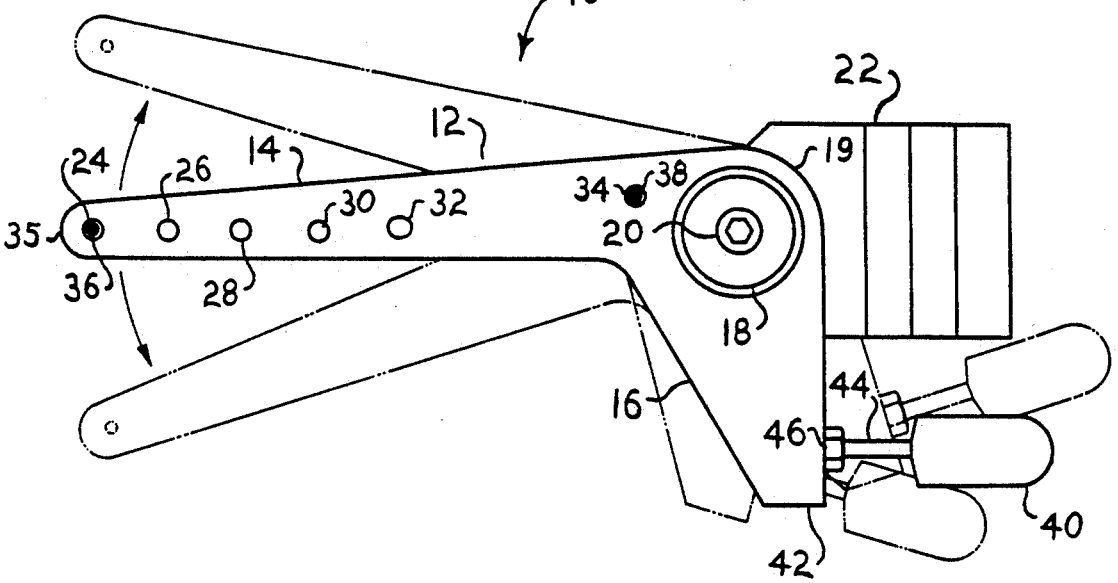
FIG. 2 is a side view of the sight, showing its arcuate displacement as would occur with variation in bow angle.

The above described pivotal mounting orientation for sight arm 12, will be seen to cause the forward and rear extensions 14 and 16 to pivot downward due to their weight, and assume a rest position generally as shown in FIG. 1. This rest position is established by the force of gravity, and will remain constant with the exception of other force inputs as the bow B is moved arcuately upward or downward. Additional adjustment for the rest position of the sight arm 12 is provided by plural threaded holes or passages 24 through 34 spaced along the forward extension 14 between the distal end 35 and the juncture 19, shown in FIG. 2, which passages 24 through 34 provide for the installation of a forward sight pin 36 and rearward sight pin 38. However, the primary adjustment is provided by a balance weight 40 extending rearwardly from the outer end 42 of the rearward extension 16.

The primary purpose of the multiple sight pin passages 24 through 32 is to provide optimum locating for the first or forward sight pin 36; the rear or second sight pin 38 will normally always be installed in the most rearward sight pin passage 34. The multiple sight pin passages 24 through 32 allow the forward sight pin to be positioned according to the weight, flight speed, and other factors which affect the arcuate flight and distance achievable by a given type of arrow or projectile, as will be explained further below. Obviously, the positioning of the first sight pin 36 in a sight pin passage closer to the pivot axle 20, will result in a smaller moment for the forward extension 14, and thus the forward extension 14 will tend to rise. The opposite is true as the first sight pin 36 is installed in a more forward position.

Accordingly, the balance weight 40 provides adjustment not only for the sight 10 itself, but also for any changes in the positioning of the forward sight pin 36.

Balance weight 40 attaches to a rod 44 which extends rearwardly from the outer end 42 of the rear extension 16 and provides adjustment (e.g., by means of threading into a hole or passage in the outer end 42 of rear extension 16) for the moment of the rear extension 16 and consequently for the overall balance of the arm 12. Securing means (e.g., a lock nut 46) is provided to prevent the deviation of the balance weight 40 from a desired adjustment.

Preferably, sight arm 12 is formed of flat, planar stock and is relatively light weight. Acrylic plastic material has been found to be suitable, but other materials may be used as desired. The mounting bracket 22 is preferably formed of aluminum, but again other materials may be used. The balance weight 40 is preferably formed of a relatively dense material (lead, steel, etc.) and is secured to a durable, preferably corrosion resistant material (e.g., stainless steel) rod 44.

Each of the sight pins 36 and 38 may be threadibly adjusted within their respective passages in order to position the sighting tips 48 and 50 of the pins 36 and 38 at a desired spacing away from the generally vertical surface plane 52 of the sight arm 12. Assuming no tendencies for an arrow or projectile to deviate left or right from a straight flight path after being fired, the two tips 48 and 50 will be equally spaced from the surface 52 of the arm 12. However, in the event of wind drift or other factor(s) which may cause the flight path of an arrow or projectile to veer to the left or right, either of the pins 34 and/or 36 may be threadibly adjusted in order to place the sighting tip(s) 48 and/or 50 nearer to or farther from the surface 52 of the sight arm 12. For example, assuming the archer is faced with a wind from the left, compensating aim must be made to the left, or into the wind. This may be accomplished by adjusting the front sight pin 36 to place the tip 48 closer to the surface 52 of the sight arm 12, and/or adjusting the rear sight pin 38 to place the tip 50 farther from the surface 52. Alignment of the two sight pin tips vertically above one another (or with one another) will result in the bow B being aimed to the left. Proper adjustment will serve to compensate for windage as required. Opposite adjustment will serve to compensate for right windage.

Figure 3:
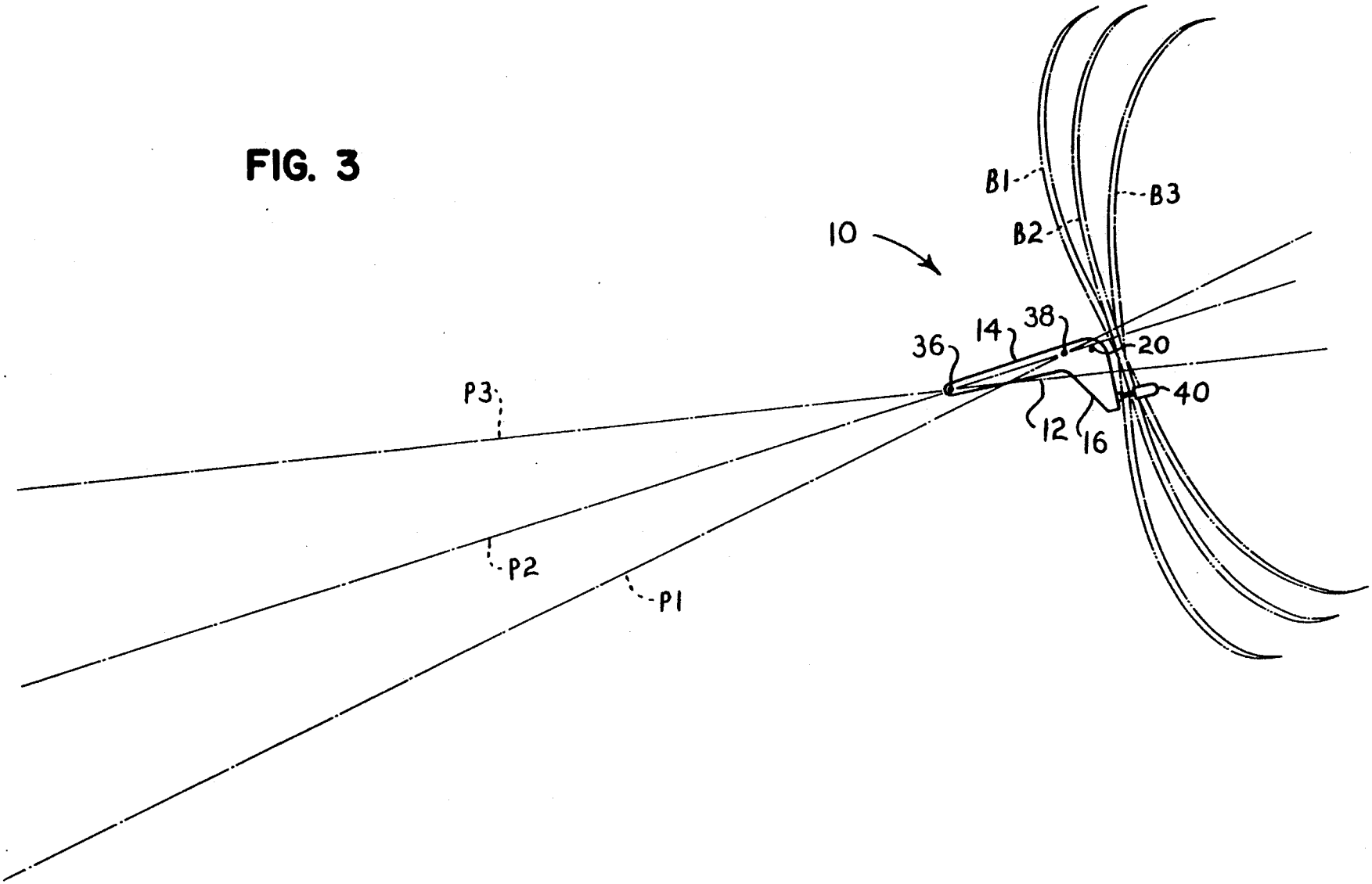
FIG. 3 is a side view of the archery bow sight of the present invention in a stable position as the attached bow is angularly adjusted for near, middle distance, and further distant targets, and further showing the relative sight lines for those targets.

The above description of adjustment for windage is essentially independent of any adjustment for the vertical flight path of an arrow or projectile. The present invention provides simple and ready adjustment for such vertical flight path elevation by means of the placement of the forward sight pin 36 in a proper sight pin hole 24 through 32, and/or the adjustment of the balance weight 40. FIG. 3 provides a schematic view of close, midrange, and distant target bow positions and their corresponding sight lines and aiming by means of the present invention. Normally, the present invention will be used in an elevated sight, such as a tree stand, and the archer will be shooting at a generally downward angle toward a target on the ground, as shown in FIG. 3. Accordingly, not only must the archer take into account the normal fall or drop of the arrow or projectile as it travels the distance from bow to target, but must also consider the reduction in that drop or fall as the flight path of the arrow or projectile becomes more vertical with decreasing distance to the target and/or increasing height above the target. The present invention provides for such compensation, as will be described below.

FIG. 3 shows three different sight lines P1, P2 and P3, corresponding respectively to a relatively close, middle distance, and distant targets and respective bow positions B1, B2 and B3. Normally, an archer using the present invention will be situated in a tree stand nominally some twenty feet or so above the surrounding terrain. In any case, the height of the archer above the terrain will remain constant for any given site once established, thus eliminating the variable of altitude for the archer. It will be noted that the angular position of the sight arm 12, which is pivotally attached to the bow B, remains constant no matter what the position of the bow may be due to the pivotally balanced nature of the arm 12; the bow (and resulting sight lines) will rotate about the arm 12 by means of axle 20 and bearing 18 as the bow is arcuately raised or lowered to adjust the sight line.

As an example of the above, bow position B1 shows a relatively downward displacement of the bow and corresponding relatively steeply inclined sight line P1 for an arrow or projectile. Such a steeply inclined sight line P1 would be appropriate for a target relatively close to the elevated position of an archer shooting from an elevated tree stand or the like. Assuming a typical height on the order of twenty feet above the surrounding terrain for the archer, the sight line represented by P1 might be appropriate for a target at a range of less than 25 yards or 75 feet. It will be noted that the sight line P1 passes through the second sight pin 38, and is below the first sight pin 36; thus, the sight pin closest to the archer, or sight pin 38, will appear to be below the first sight pin 36 for a closer target.

In the case of a target at a greater distance than 25 yards or 75 feet from the elevated archer, the bow will assume a more vertical position generally as shown at B3 and the corresponding sight line P3 will accordingly be closer to the horizontal. However, as noted above, the sight arm 12 will remain in the same orientation relative to level as the bow and archer's sight line are rotated about the sight arm 12. This will result in the sight line being through the first sight pin 36, which pin 36 is farther from the archer than the second sight pin 38. It will be noted that this sight line P3 for more distant targets, passes below the second sight pin 38; thus, the first sight pin 36 will appear to be below the second sight pin 38 for more distant targets (from 25 to 50 yards from the archer).

For middle distance targets on the order of 25 yards from the archer, the bow and sight line will take on angles approximately as shown by bow B2 and sight line P2. It will be seen that the sight line P2 passes directly through both the first sight pin 36 and the second sight pin 38 for such an intermediate distance target, thus making the alignment of the two sight pins 36 and 38 a simple matter for the archer.

The bow sight 10 of the present invention is sighted in and adjusted by using the above described principles of use. Once the elevated stand is situated, the archer selects a sight pin position 24 through 32 appropriate for the first or forward sight pin 36, depending upon the type of arrows or projectiles to be used and/or other factors. The second or rearward sight pin 38, which is closer to the archer, will remain in the closer sixth sight pin hole 34. The archer then fires one or more arrows or projectiles at a known target some 20 yards from the base of the elevated stand, making adjustments to either the mounting bracket 22 attachment to the bow B or bow extension E, and/or to the balance weight 40 until the closer or rear sight pin 38 provides sufficient accuracy. When this closer distance is sighted in, the archer then fires one or more arrows or projectiles at a target some 40 yards from the base of the stand, and repeats the adjustments as necessary using the first or farther sight pin 36 until sighted in. It will be seen that there may be some need to readjust for closer distances when the more distant sighting in process is completed, as each distance adjustment will have some bearing on the other. However, the process is easily accomplished in a few minutes with the firing of several arrows from one position, and will provide shooting accuracy from such an elevated stand for relatively close distances (e.g., 10 to 25 yards) by using the closer sight pin 38, relatively greater distances (e.g., 30 to 50 yards) by using the farther sight pin 36, and for middle distances (e.g., approximately 25 yards) by aligning the two sight pins 36 and 38.

Accordingly, it will be seen that the archer will always use the sight pin 36 or 38 which appears to be the lowest of the two for sighting. In the case of more distant targets, this will be the farther sight pin 36. In the case of closer targets, this will be the closer sight pin 38. In the case of middle distance targets, the two sight pins 36 and 38 will appear to be aligned with one another, so both may be used. Thus, the present invention provides extremely simply aiming by simply using whichever sight pin appears lowest, or both sight pins if neither appears higher than the other.

It is to be understood that the present invention is not limited to the sole embodiment described above, but encompasses any and all embodiments within the scope of the following claims.

I claim:

1. A pendulum bow sight attachable to an archery bow and providing for use from elevated sites and providing near, intermediate and distant target alignment, said bow sight comprising:

a pivotally mounted sight arm having a forward extension and a rear extension including an angled juncture therebetween and thereby having a substantially L shaped form, with said forward extension being longer than said rear extension;

said sight arm including bearing means at said juncture with said bearing means being secured to and cooperating with an axle, said bearing means providing for the pivotal movement of said sight arm about said axle with said forward extension and said rear extension depending from said juncture and thereby providing pendulum means for said sight arm;

said axle being generally horizontally disposed and secured to a mounting bracket, with said mounting bracket providing for the adjustable attachment of said bow sight to an archery bow;

said forward extension of said sight arm including a distal end and a plurality of first sight pin passages and a single second sight pin passage disposed between said distal end and said juncture with said second sight pin passage disposed between said first sight pin passages and said juncture;

one of said first sight pin passages including a first sight pin threadibly installed therein and said second sight pin passage including a second sight pin threadibly installed therein, whereby;

said sight arm maintains a predetermined position by said pendulum means as an archer adjusts a bow to cause said first sight pin to appear lower than said second sight pin for relatively distant targets, said second sight pin to appear relatively lower than said first sight pin for relatively close targets, and said first sight pin and said second sight pin to appear aligned for middle distance targets as the bow is downwardly aimed at one of the targets.

2. The bow sight of claim 1 wherein:

said first sight pin and said second sight pin are each laterally adjustable, thereby providing lateral adjustment for windage correction.

3. The bow sight of claim 1 wherein:

said plurality of first sight pin passages in said forward extension of said sight arm comprise five sight pin passages, whereby said first sight pin is removably installable in one of said five sight pin passages as desired to provide adjustment.

4. The bow sight of claim 1 wherein:

said bearing means comprises a ball bearing.

5. The bow sight of claim 1 including:

means providing for the adjustment of the balance of said sight arm.

6. The bow sight of claim 5 wherein:

said means providing for the adjustment of the balance of said sight arm comprises a balance weight secured to said sight arm.

7. The bow sight of claim 6 wherein:

said balance weight is secured to said rear extension of said sight arm.

8. The bow sight of claim 6 wherein:

said balance weight includes a threaded rod threadibly adjustable relative to said rear extension.

9. The bow sight of claim 8 wherein:

said threaded rod includes a lock nut thereon providing locking means for the adjustment of said balance weight.

10. The bow sight of claim 1 wherein:

said sight arm is formed of flat, planar stock material.

11. The bow sight of claim 1 wherein:

said sight arm is formed of acrylic plastic material.

12. The bow sight of claim 1 wherein:

said mounting bracket is formed of aluminum.

13. A method of using a pendulum bow sight for relatively close, middle distance, and distant targets from an elevated site, the method comprising the following steps:

providing a pendulum bow sight adjustably attached to a bow and having a pivotally mounted sight arm with the sight arm having depending forward and rear extensions in a substantially L shaped configuration and a bearing at the juncture thereof, the forward extension having a distal end with a plurality of first sight pin passages and a second sight pin passage disposed between the distal end and the juncture with the second sight pin passage disposed between the first sight pin passages and the juncture, a first sight pin installed in one of the first sight pin passages and a second sight pin installed in the second sight pin passage, and an adjustable balance weight installed upon the sight arm, and proceeding with one of the following steps;

aligning the second sight pin with a predetermined target at relatively close range and with the second sight pin appearing lower than the first sight pin;

aligning the first sight pin with a predetermined target at relatively distant range and with the first sight pin appearing lower than the second sight pin; or, aligning the first sight pin with the second sight pin and with a predetermined target at an intermediate range.

14. The method of claim 13 including the steps of:

aiming the bow to shoot at a predetermined target at relatively close range and adjusting the bow sight attachment and balance weight to provide accurate aim at the predetermined relatively close target when the second sight pin appears lower than the first sight pin; and aiming the bow to shoot at a predetermined target at relatively distant range and adjusting the bow sight attachment and balance weight to provide accurate aim at the predetermined relatively distant target when the first sight pin appears lower than the second sight pin.

15. The method of claim 13 including the step of:

adjustably moving the first sight pin from one of the first sight pin passages to another of the first sight pin passages and thereby providing compensation for arrows having different characteristics.

* * * * *